US005879745A

United States Patent [19]

Reiter et al.

[11] Patent Number: 5,879,745

[45] Date of Patent: Mar. 9, 1999

[54] METHOD FOR STABILIZING A PATINA LAYER

[75] Inventors: Ulrich Reiter, Osnabrück; Stefan Priggemeyer, Wallenhorst; Stefan Hoveling, Osnabrück, all of Germany

[73] Assignee: KM Europa Metal AG, Osnabrück, Germany

[21] Appl. No.: 730,834

[22] Filed: Oct. 17, 1996

[30] Foreign Application Priority Data

Oct. 20, 1995 [DE] Germany ..... 195 39 158.6

[51] Int. Cl.[6] ..... B05D 1/02; B05D 1/18

[52] U.S. Cl. ..... 427/379; 427/388.4; 427/421; 427/435; 106/14.44; 106/618; 148/269; 148/272

[58] Field of Search ..... 427/435, 388.1, 427/388.4, 379, 421; 106/14.44, 618; 148/269, 272

[56] References Cited

U.S. PATENT DOCUMENTS

| | | | |
|---|---|---|---|
| 1,012,887 | 12/1911 | Medveczky . | |
| 2,339,200 | 1/1944 | Sowa . | |
| 2,350,161 | 5/1944 | Gloor . | |
| 3,960,576 | 6/1976 | Carter et al. | 106/14 |
| 4,341,878 | 7/1982 | Marcantonio et al. | 524/3 |

FOREIGN PATENT DOCUMENTS

| | | |
|---|---|---|
| 742291 | 11/1996 | European Pat. Off. . |
| 1527052 | 5/1968 | France . |
| 1004492 | 1/1989 | Japan . |
| 5098497 | 4/1993 | Japan . |

OTHER PUBLICATIONS

Translation of JP 64–004492, Jan. 1989.

Translation of JP 5–098497, Apr. 1993.

Translation of FR 1527052.

*Primary Examiner*—Erma Cameron

*Attorney, Agent, or Firm*—Kenyon & Kenyon

[57] ABSTRACT

In the method for stabilizing an artificial patina layer produced on a copper panel, a transparent cover layer consisting of water glass and hydroxycellulose is applied onto the patina layer immediately after it is produced. The cover layer can consist of sodium or potassium water glass and hydroxycellulose, and is applied onto an artificially patinated copper panel by either immersion or spraying. After immersion or spraying, the cover layer is dried. This occurs in an atmosphere with a temperature of approximately 20° C. to 150° C., within a time period of approximately one to one and a half hours.

7 Claims, No Drawings

METHOD FOR STABILIZING A PATINA LAYER

FIELD AND BACKGROUND OF THE INVENTION

The invention concerns a method for stabilizing an artificial patina layer produced on a copper panel.

In the processing of copper panels with an artificial patina layer, it has been found that, in particular when such copper panels are bent, the patina layer at least partially detaches. The chips and dust resulting from this can lead to environmental impacts, in particular to skin irritation and to tool corrosion.

Although efforts have already been made to protect an artificial patina layer with clear varnish, clear varnish cannot be applied until after the "maturing" process of an artificial patina layer is complete. The reason for applying the clear varnish after completion of the maturing process is that clear varnish is not porous enough to allow the maturing process to proceed. The "maturing process" is understood to mean a reaction in which the artificial patina layer is exposed to the atmosphere for a period of approximately one week to several weeks. During this period the crystal structures of the artificial patina then react in combination with atmospheric moisture in such a way that the particular desired patina is achieved in terms of both color and structure.

But even when the clear varnish is applied after completion of the maturing process, it is basically impossible to prevent moisture from migrating under the clear varnish layer from the edges of a copper panel or from the machining edges. The clear varnish layer can then chip and thereby take at least portions of the artificial patina layer with it. Moreover when clear varnish is used it is impossible to prevent it from cracking over large areas, or to prevent hairline cracks in the clear varnish layer through which moisture can penetrate. This again ultimately allows the entire coating, consisting of clear varnish and artificial patina, to be pulled off somewhat like a skin. This would, however, cause the artificially generated patina to disappear.

In order to eliminate the disadvantages referred to above, until now copper panels equipped with an artificial patina layer have usually been reshaped, directly after production of the patina layer, in the manner desired based on the application. The copper panels reshaped in this manner were then exposed to the open atmosphere in order to allow the maturing process to proceed.

SUMMARY AND OBJECTS OF THE INVENTION

It is the object of the invention, proceeding from the prior art, to create a method for stabilizing an artificial patina layer produced on a copper panel which is not impeded by the maturing process of the patina layer, and which allows easy processing, for example reshaping, of a copper panel even during the maturing process.

According to the invention, this object is achieved by the features cited in the claims.

DETAILED DESCRIPTION OF THE INVENTION

According to this, a transparent cover layer consisting of water glass and hydroxycellulose is applied onto the patina layer immediately after it is artificially produced. A cover layer of this kind has the nature and function of a network, with the effect that on the one hand this cover layer is sufficiently porous to allow the maturing process of the patina to proceed in the requisite way, and on the other hand the patina is held firmly on the surface of the copper panel during a deformation, for example a bending process, so that it can neither detach in portions from the copper panel, nor be pulled off over large areas. Thus chips and dusting are avoided. Skin irritation and tool corrosion are suppressed. Environmental impact due to detached patina does not occur. Moreover the network-like transparent cover layer has the advantage that even after a long period, it retains its shape and does not tear. When the cover layer does ultimately detach, due to weathering effects, after installation of a patinated copper panel, this has no further influence on the quality of the patina layer or on the processing of an artificially patinated copper panel.

An advantageous embodiment of the method according to the invention comprises immersing an artificially patinated copper panel into a solution of sodium or potassium water glass and hydroxycellulose, and subsequently drying the applied transparent cover layer.

A further equally advantageous form of the method according to the invention comprises spraying an artificially patinated copper panel with a solution of sodium or potassium water glass and hydroxycellulose and then drying.

According to the invention it is furthermore advantageous if drying of the applied transparent cover layer is performed in an atmosphere having a temperature of approximately 20° C. to 150° C.

The invention is explained in greater detail below with reference to a production example.

According to this, first 40 ml potassium water glass and 120 ml water, as well as 80 g hydroxycellulose (mixed at a 1:20 ratio with water), were stirred for approximately one hour. Then the solution was sprayed onto the surface of a copper panel that had previously been artificially patinated. After spraying, the artificially patinated copper panel thus equipped with a transparent cover layer was dried first for 15 minutes at 100° C., and then for another hour at 120° C.

A test with a copper panel treated in this manner, in which chemical resistance was tested over a period of five minutes with 0.5 molar nitric acid at room temperature, showed only negligible attack on the patina layer.

Mechanical strength was tested by means of a friction test with steel wool. No visible abrasion was noted.

Lastly a bending test was performed by executing a sharp 90° bend. This did not cause the patina layer to chip.

Overall, it is evident with reference to the method according to the invention that the visual appearance of the artificially patinated surface of the copper panel is not changed in a relevant way by the transparent cover layer consisting of water glass and hydroxycellulose. Abrasion resistance, processability, etc. are moreover greatly improved. Chips and dusting, as well as the problems associated therewith, for example skin irritation and tool corrosion, are avoided. The cover layer is nevertheless sufficiently porous to permit the maturing process of the artificially produced patina layer within the necessary time period in the open atmosphere.

What is claimed is:

1. A method for stabilizing an artificial patina layer produced on a copper panel, comprising applying a transparent cover layer comprising water glass and hydroxycellulose onto the patina layer immediately after the patina layer is produced.

2. The method of claim 1, further comprising step of drying said transparent cover layer.

3. The method of claim 2, wherein said water glass is selected from the group consisting of sodium water glass and potassium water glass.

4. The method of claim 1, wherein said transparent cover layer is applied by spraying.

5. The method of claim 1, wherein said transparent cover layer is applied by immersing said patina layer in said transparent cover layer.

6. The method of claim 2, wherein said drying step is carried out at a temperature of about 20° C. to about 150° C.

7. The method of claim 6, wherein said drying step is carried out for about 15 minutes at a temperature of about 100° C. and then is carried out for about 60 minutes at a temperature of about 120° C.

* * * * *